US007654771B2

(12) United States Patent
Schroeder et al.

(10) Patent No.: US 7,654,771 B2
(45) Date of Patent: Feb. 2, 2010

(54) SPRAY GUN MOUNT FOR LINE STRIPER

(75) Inventors: James C. Schroeder, Ramsey, MN (US); Robert J. Gundersen, Otsego, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 190 days.

(21) Appl. No.: 11/813,934

(22) PCT Filed: Jan. 26, 2006

(86) PCT No.: PCT/US2006/002824

§ 371 (c)(1),
(2), (4) Date: Jul. 13, 2007

(87) PCT Pub. No.: WO2006/081373

PCT Pub. Date: Aug. 3, 2006

(65) Prior Publication Data

US 2008/0205984 A1 Aug. 28, 2008

Related U.S. Application Data

(60) Provisional application No. 60/647,512, filed on Jan. 27, 2005.

(51) Int. Cl.
*E01C 23/22* (2006.01)

(52) U.S. Cl. ..... 404/94; 404/93

(58) Field of Classification Search ..... 404/93, 404/94

See application file for complete search history.

(56) References Cited

U.S. PATENT DOCUMENTS

| | | | | | |
|---|---|---|---|---|---|
| 2,076,172 | A * | 4/1937 | Bowden | 404/94 |
| 3,352,283 | A * | 11/1967 | Burns | 118/301 |
| 3,687,371 | A | 8/1972 | Carl J. Swager | |
| 4,624,602 | A | 11/1986 | Kieffer et al. | |
| 4,877,348 | A | 10/1989 | Opie | |
| 4,893,751 | A | 1/1990 | Armstrong | |
| 5,114,268 | A * | 5/1992 | Marcato | 404/92 |
| 5,213,480 | A | 5/1993 | Yedinak et al. | |
| 5,263,789 | A | 11/1993 | Torntore et al. | |
| 5,302,207 | A | 4/1994 | Jurcisin | |
| 5,368,232 | A | 11/1994 | Schroeder | |
| 5,951,201 | A * | 9/1999 | Jones | 404/94 |
| 6,027,281 | A * | 2/2000 | Neuling | 404/75 |
| 6,547,158 | B1 | 4/2003 | Smith | |
| 7,140,555 | B1 * | 11/2006 | Bricko et al. | 239/124 |
| 7,150,413 | B1 * | 12/2006 | Bricko et al. | 239/150 |
| 7,367,515 | B1 * | 5/2008 | Newman | 239/150 |
| 2009/0087263 | A1 * | 4/2009 | Martinez et al. | 404/94 |

* cited by examiner

*Primary Examiner*—Gary S Hartmann
(74) *Attorney, Agent, or Firm*—Douglas B. Farrow

(57) ABSTRACT

A spray gun mounting tube (116) in a walk behind gas powered line striper (110) is clamped to only one side (112) of the striper frame. The mass of the spray gun (122) and gun mounting bracket (120) allows the gun (122) to hold a steady position.

1 Claim, 5 Drawing Sheets

$X = (W/D1/2)(D2 + (D1/2))$ (F1) AND (F2) ARE 100% OUT OF PHASE

SPRAY GUN MOUNT FOR LINE STRIPER

This application claims the benefit of U.S. Application Ser. No. 60/647,512, filed Jan. 27, 2005.

TECHNICAL FIELD

Background Art

Gasoline powered walk behind line stripers have become popular in recent years for smaller striping jobs. One problem which has developed is that the gasoline engines used (similar in type and size to those used with lawn mowers) have a substantial amount of vibration. This may cause the spray gun to move relative to the ground and thus vary the size/width of the stripe when mounted to both sides of the striper frame.

DISCLOSURE OF THE INVENTION

A spray gun mounting tube is clamped to only one side of the striper frame. The mass of the spray gun and gun mounting bracket appears allow the gun to hold a steady position.

These and other objects and advantages of the invention will appear more fully from the following description made in conjunction with the accompanying drawings wherein like reference characters refer to the same or similar parts throughout the several views.

BEST MODE FOR CARRYING OUT THE INVENTION

Figure 1:
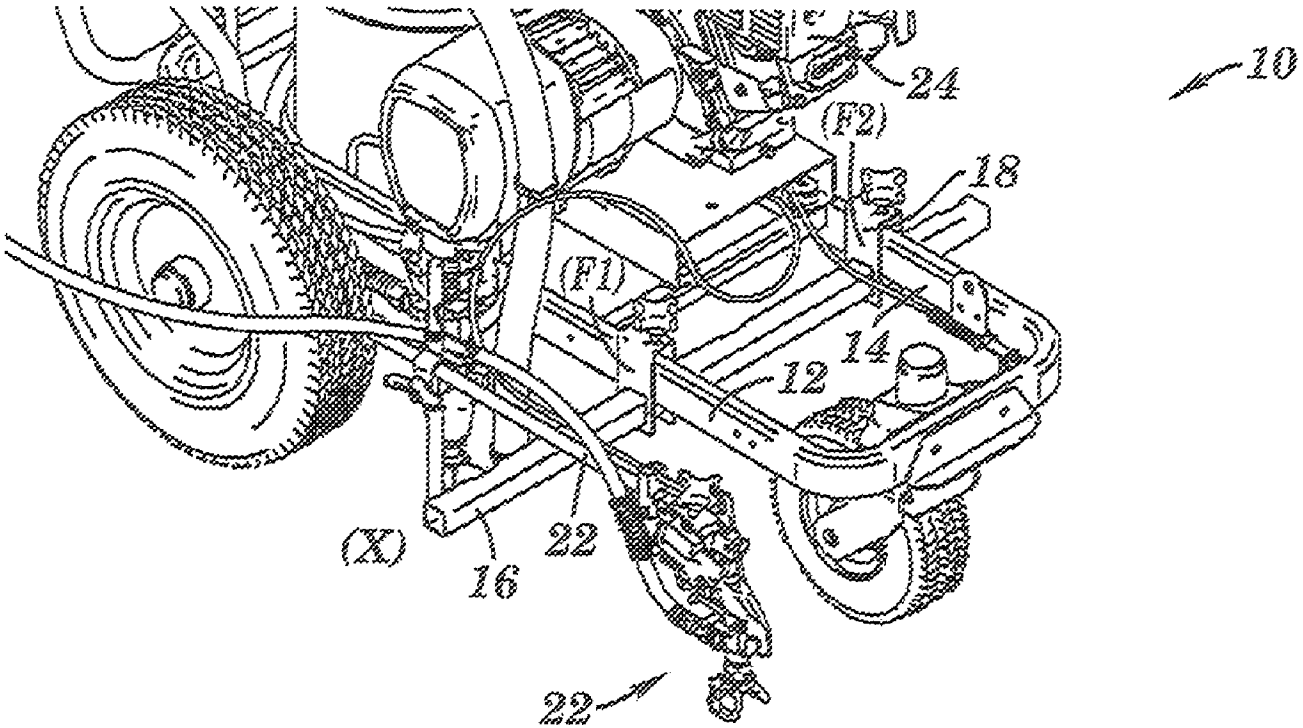
FIG. 1 PRIOR ART
FIG. 1 shows a typical prior art striper gun mount.

A walk behind line striper 10 typical of the prior art is shown in FIG. 1. Striper 10 has main frame rails 12 and 14 which run generally parallel to one another. A gun mount tube 16 is mounted to rails 12 and 14 using clamps 18. A mounting bracket 20 is attached to gun mount tube 16 and retains spray gun 22 therein. A gasoline engine 24 is mounted on frame rails 12 and 14.

Figure 5:
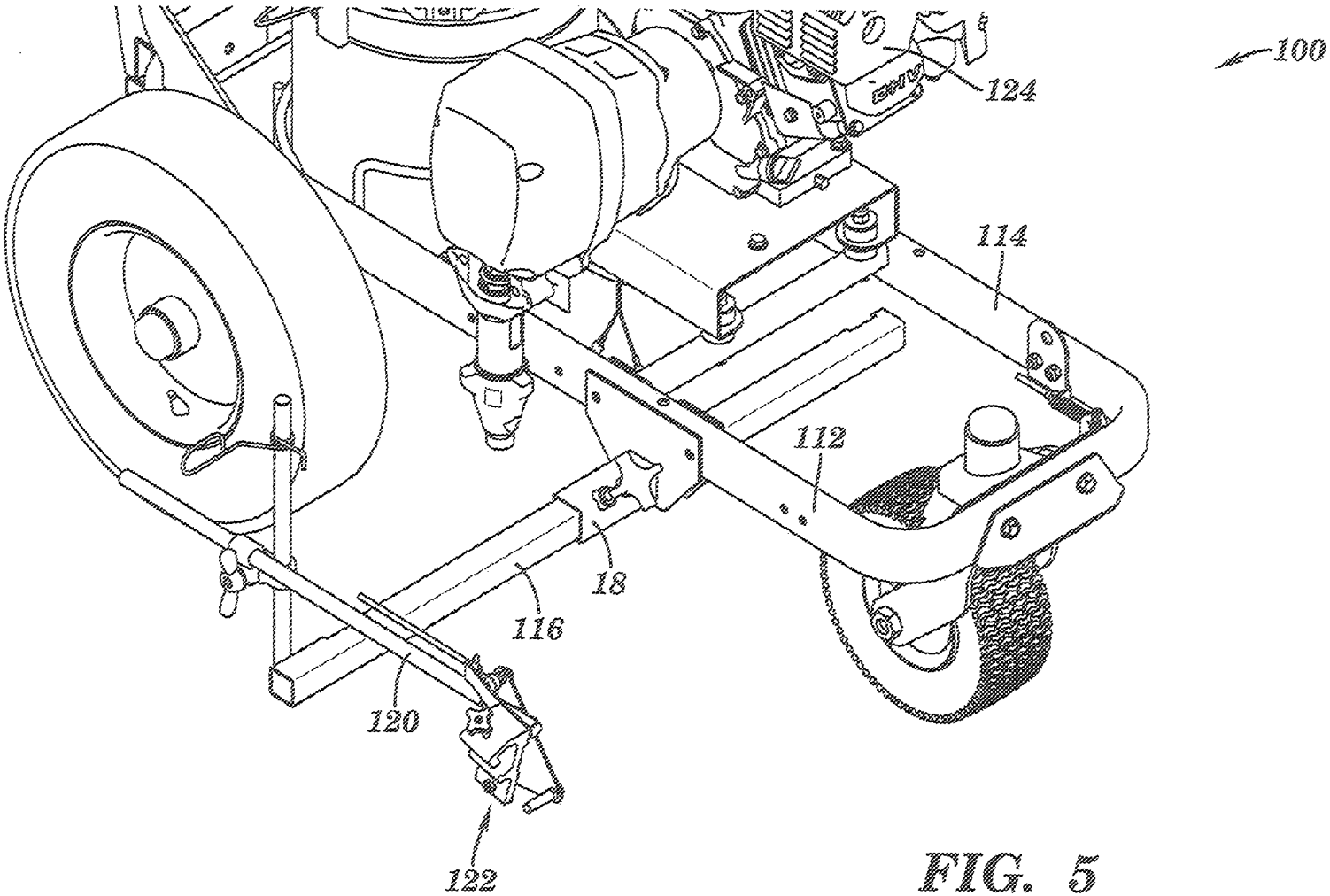
FIG. 5 shows the striper gun mount of the instant invention.

In striper 100 of the instant invention shown in FIG. 5, frame rails 112 and 114 run generally parallel to one another. A gun mount tube 116 is mounted to rail 112 only using clamp 18. A mounting bracket 120 is attached to gun mount tube 116 and retains spray gun 122 therein. A gasoline engine 124 is mounted on frame rails 112 and 114.

Figure 2:
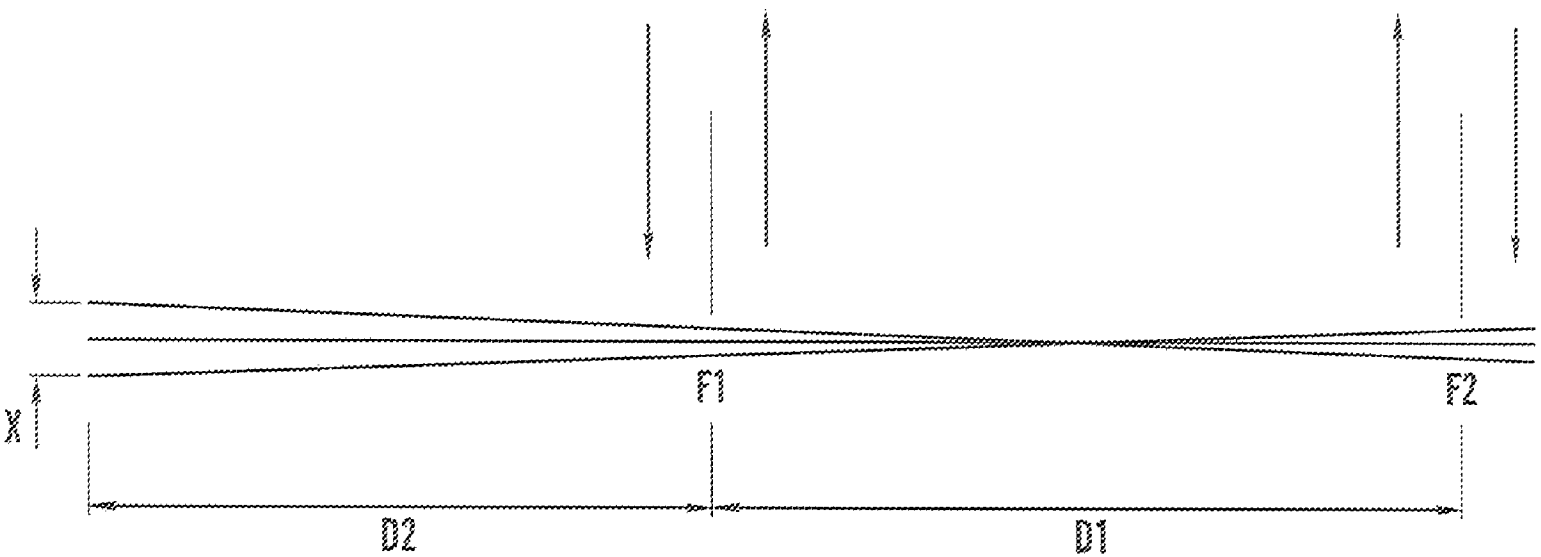
FIG. 2 shows a vibration diagram of a typical prior art striper gun mount.

FIG. 2 shows a prior art type system where the gun mount tube is fixed to the frame rails at points F1 and F2 and where the vibration at those two points is completely out of phase.

Figure 3:
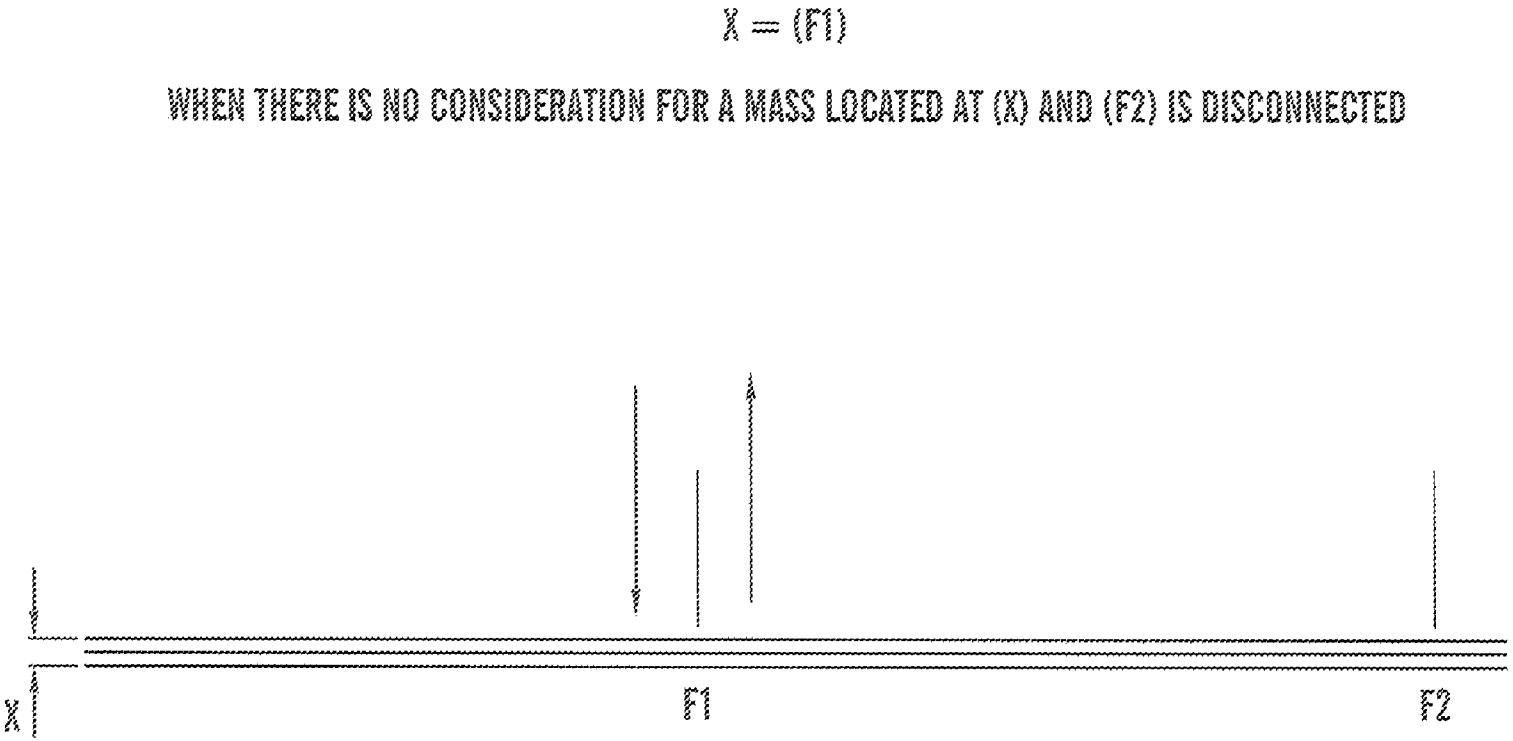
FIG. 3 shows a vibration diagram of the instant invention striper gun mount without consideration for the mass of the spray gun.

FIG. 3 shows a striper where the gun mount tube is fixed to only one frame rail at point F1 and where there is no mass (such as a spray gun) located at the end of the gun mount tube.

Figure 4:
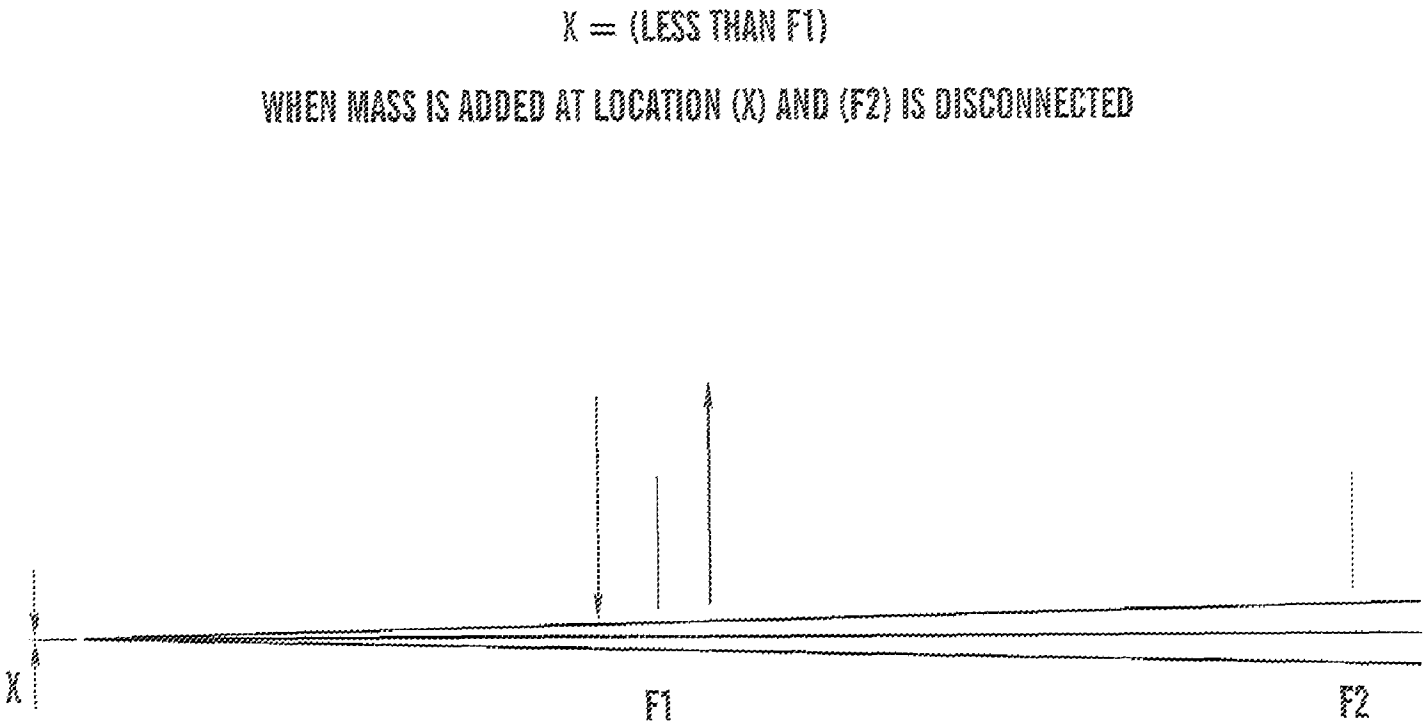
FIG. 4 shows a vibration diagram of the instant invention striper gun mount with consideration for the mass of the spray gun.

FIG. 4 shows the instant invention where the gun mount tube is fixed to only one frame rail at point F1 and where there is a mass (such as a spray gun) located at the end of the gun mount tube. This shows that by adding mass to this arrangement, the spray gun is harder to vibrate and more likely to remain in a fixed position.

It is contemplated that various changes and modifications may be made to the spray gun mount without departing from the spirit and scope of the invention as defined by the following claims.

The invention claimed is:

1. In a line striper having an engine, a spray gun, a spray gun mounting tube and first and second frame rails having wheels mounted thereto with an axis of rotation, the improvement comprising said spray gun mounting tube being mounted to only one of said frame rails substantially parallel to said axis of rotation and wherein said spray gun mounting tube has first and second ends and said spray gun is mounted adjacent said first end and said spray gun mounting tube is mounted to one of said frame rails intermediate said first and second ends.

* * * * *